United States Patent [19]

Bloom et al.

[11] 4,142,890

[45] Mar. 6, 1979

[54] PHOTOSENSITIVE TRANS-EPINDOLIDIONE PIGMENT FOR MIGRATION IMAGING PROCESSES

[75] Inventors: Melvin S. Bloom, Penfield; Michael T. Regan, Fairport, both of N.Y.

[73] Assignee: Eastman Kodak Company, Rochester, N.Y.

[21] Appl. No.: 857,730

[22] Filed: Dec. 5, 1977

Related U.S. Application Data

[63] Continuation-in-part of Ser. No. 798,957, May 20, 1977, abandoned.

[51] Int. Cl.[2] ..... G03G 13/24; G03G 5/12; G03G 5/06

[52] U.S. Cl. ..... 96/1 PE; 96/1.3; 96/1.2; 96/1.5 R; 106/23

[58] Field of Search ..... 96/1.3, 1 PE, 1.5; 260/288 CF, 345.2

[56] References Cited

U.S. PATENT DOCUMENTS

| | | | |
|---|---|---|---|
| 3,334,102 | 8/1967 | Aldridge et al. | 260/288 |
| 3,474,020 | 10/1969 | Tulagin et al. | 96/1 PE |
| 3,888,665 | 6/1975 | Wiedemann | 96/1.5 |

*Primary Examiner*—Roland E. Martin, Jr.
*Assistant Examiner*—John L. Goodrow
*Attorney, Agent, or Firm*—John R. Everett

[57] ABSTRACT

Trans-epindolidione is a useful yellow material in forming photoelectrophoretic migration images.

9 Claims, 1 Drawing Figure

PHOTOSENSITIVE TRANS-EPINDOLIDIONE PIGMENT FOR MIGRATION IMAGING PROCESSES

Figure 1:
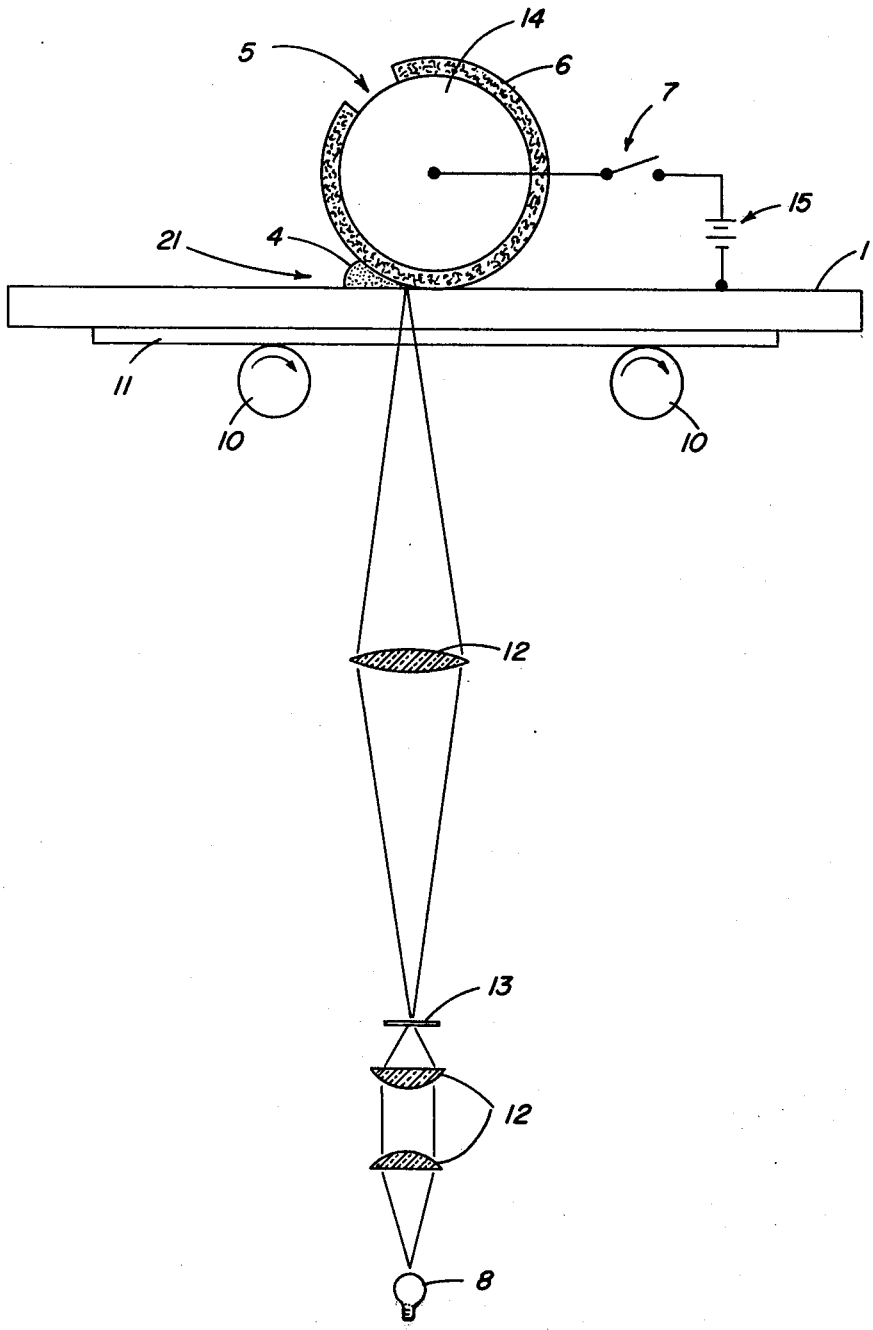

This application is a continuation-in-part of U.S. Pat. application No. 798,957 filed May 20, 1977, now abandoned.

FIELD OF THE INVENTION

This invention relates to electrophoretic migration imaging processes and, in particular, to the use of certain photosensitive pigment materials in such processes.

BACKGROUND OF THE INVENTION

In the past, there has been extensive description in the patent and other technical literature of electrophoretic migration imaging processes. For example, a description of such processes may be found in U.S. Pat. Nos. 2,758,939 by Sugarman issued Aug. 14, 1956; 2,940,847; 3,100,426; 3,140,175 and 3,143,508, all by Kaprelian; 3,384,565; 3,384,488 and 3,615,558, all by Tulagin et al.; 3,384,566 by Clark; and 3,383,993 by Yeh. In addition to the foregoing patent literature directed to conventional photoelectrophoretic migration imaging processes, another type of photoelectrophoretic migration imaging process which advantageously provides for image reversal is described in Groner, U.S. Pat. No. 3,976,485 issued Aug. 24, 1976.

In general, each of the foregoing electrophoretic migration imaging processes typically employs a layer of electrical charge-bearing photoconductive particles, i.e., electrically photosensitive particles, positioned between two spaced electrodes, one of which may be transparent. To achieve image formation in these processes, the charge-bearing photosensitive particles positioned between the two spaced electrodes, as described above, are subjected to the influence of an electric field and exposed to activating radiation. As a result, the charge-bearing electrically photosensitive particles are caused to migrate electrophoretically to the surface of one or the other of the spaced electrodes, and one obtains an image pattern on the surface of these electrodes. Typically, a negative image is formed on one electrode, and a positive image is formed on the opposite electrode. Image discrimination occurs in the various electrophoretic migration imaging processes as a result of a net change in charge polarity of either the exposed electrically photosensitive particles (in the case of conventional electrophoretic migration imaging) or the unexposed electrically photosensitive particles (in the case of the electrophoretic migration imaging process described in the above-noted Groner patent application) so that the image formed on one electrode surface is composed ideally of electrically photosensitive particles of one charge polarity, either negative or positive polarity, and the image formed on the opposite polarity electrode surface is composed ideally of electrically photosensitive particles having the opposite charge polarity, either positive or negative.

In any case, regardless of the particular electrophoretic migration imaging process employed, it is apparent that an essential component of any such process is the electrically photosensitive particles. And, of course, to obtain an easy-to-read, visible image it is important that these electrically photosensitive particles be colored, as well as electrically photosensitive. Accordingly, as is apparent from the technical literature regarding electrophoretic migration imaging processes, work has been carried on in the past and is continuing, to find particles which possess both useful levels of electrical photosensitivity and which exhibit good colorant properties. Thus, for example, various types of electrically photosensitive materials are disclosed for use in electrophoretic migration imaging processes, for example, in U.S. Pat. Nos. 2,758,939 by Sugarman, 2,940,847 by Kaprelian, and 3,384,488; 3,474,020 and 3,615,558 by Tulagin et al., noted hereinabove.

Yellow electrically photosensitive materials are useful in migration imaging processes. Such materials are particularly useful in photoelectrophoretic polychrome migration imaging processes based on a subtractive multicolor system. However, yellow electrically photosensitive materials disclosed in the prior art have been considered unsatisfactory for one reason or another. For an example the widely used Indofast yellow results in the formation of polychrome images in which the rendition of reds and greens is less than desired. There is a need for a yellow electrically photosensitive material which form better images in photoelectrophoretic imaging processes.

SUMMARY OF THE INVENTION

We have now discovered that trans-epindolidione having the structure

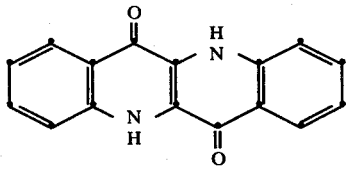

is highly useful as an electrophotosensitive material in migration imaging processes, particularly electrophoretic migration imaging processes. Trans-epindolidione exhibits (1) an excellent yellow hue which is particularly useful in photoelectrophoretic polychrome migration imaging processes based on subtractive multicolor systems, (2) minimal undesirable particle interaction polychrome imaging compositions (3) high speed, (4) light fast images and (5) images of high density.

These properties of trans-epindolidione are especially surprising and unexpected in view of the fact that in our search for an acceptable yellow electrically photosensitive material, we tested many structurally similar materials such as cisepindolindione and diquinolonopyridone which provide very poor or no image and/or images of the wrong color when used in electrophoretic migration imaging systems.

When used in a photoelectrophoretic migration imaging process, the charge-bearing electrically photosensitive particles of the present invention are positioned between two spaced electrodes; preferably these particles are contained in an electrically insulating carrier such as an electrically insulating liquid or an electrically insulating, liquefiable matrix material, e.g., a thixotropic or a heat-and/or solvent-softenable material, which is positioned between the spaced electrodes. While so positioned between the spaced electrodes, the photosensitive particles used in the invention are subjected to an electric field and exposed to a pattern of activating radiation. As a consequence, the charge-bearing, electrically photosensitive particles undergo a radiation-induced variation in their charge polarity and migrate to one or the other of the electrode surfaces to form on at least one of these electrodes an image pattern representing a positive-sense or negative-sense image of the original radiation exposure pattern.

PREFERRED EMBODIMENTS OF THE INVENTION

According to the present invention, there is provided a photoelectrophoretic migration imaging process comprising the steps of:

(a) positioning an electrically photosensitive material between at least two electrodes;
(b) subjecting said material to an electric field;
(c) exposing said material to an image pattern of radiation to which said material is photosensitive characterized in that at least a portion of said electrically photosensitive material is trans-epindolidione.

In photoelectrophoretic migration imaging, trans-epindolidione results in excellent high density yellow images. In trimixes this material does not result in muddy colored images. This indicates the absence of substantial particle-particle interaction between trans-epindolidione and the other electrophotosensitive components of the trimix.

Methods of making trans-epindolidione are described, for an example in U.S. Pat. No. 3,334,102 to Aldridge et al., issued Aug. 1, 1967 and Jaffe et al., Journal of Organic Chemistry 33 (11), 4004 (1968), wherein epindolidiones are disclosed as pigments in coating compositions and in coloring plastics, rubber, paper, linoleum, and the like.

Trans-epindolidione exhibits certain other properties which make it quite useful in photoelectrophoretic migration imaging processes. It is insoluble or only slightly soluble in conventional organic solvents. This latter property of insolubility in conventional organic solvents is advantageous in electrophoretic migration imaging processes, particularly in those embodiments of such processes wherein the electrically photosensitive material is dispersed in particulate form in an electrically insulating carrier such as a conventional aliphatic hydrocarbon liquid to form an electrophoretic migration imaging suspension.

As indicated hereinabove, the electrically photosensitive colorant material described herein is useful in the preparation of electrically photosensitive imaging particles for electrophoretic migration imaging processes. In general, electrically photosensitive particles useful in such processes have an average particle size within the range of from about 0.01 micron to about 20 microns, preferably from about 0.01 to about 5 microns. Typically, these particles are composed of one or more colorant materials such as those described in the present invention. However, these electrically photosensitive particles may also contain various nonphotosensitive materials such as electrically insulating polymers, charge control agents, various organic and inorganic fillers, as well as various additional dyes or pigment materials to change or enhance various colorant and physical properties of the electrically photosensitive particle. In addition, such electrically photosensitive particles may contain other photosensitive materials such as various sensitizing dyes and/or chemical sensitizers to alter or enhance their response characteristics to activating radiation.

The electrically photosensitive material, in particulate form, may be dispersed simply as a dry powder between two spaced electrodes and then subjected to a typical electrophoretic migration imaging operation such as that described in U.S. Pat. No. 2,758,939 by Sugarman referenced hereinabove. In general, however, the electrically photosensitive particulate material is dispersed in an electrically insulating carrier, such as an electrically insulating liquid, or an electrically insulating, liquefiable matrix material, such as a heat-and/or solvent-softenable polymeric material or a thixotropic polymeric material. Typically, when one employs such a dispersion of electrically photosensitive particulate material and electrically insulating carrier material between the spaced electrodes of an electrophoretic migration imaging system, it is conventional to employ from about 0.05 part to about 2.0 parts of electrically photosensitive particulate material for each 10 parts by weight of electrically insulating carrier material.

As indicated above, when the electrically photosensitive particles used in the present invention are dispersed in an electrically insulating carrier material, such carrier material may assume a variety of physical forms and may be selected from a variety of different materials. For example, the carrier material may be a matrix of an electrically insulating, normally solid polymeric material capable of being softened or liquefied upon application of heat, solvent, and/or pressure so that the electrically photosensitive particulate material dispersed therein can migrate through the matrix. In another, more typical embodiment of the invention, the carrier material can comprise an electrically insulating liquid such as decane, paraffin, Sohio Odorless Solvent 3440 (a Kerosene fraction marketed by the Standard Oil Company, Ohio), various isoparaffinic hydrocarbon liquids such as those sold under the trademark Isopar G by Exxon Corporation and having a boiling point in the range of 145° C. to 186° C., various halogenated hydrocarbons such as carbon tetrachloride, trichloromonofluoromethane, and the like, various alkylated aromatic hydrocarbon liquids such as the alkylated benzenes, for example, xylenes, and other alkylated aromatic hydrocarbons such as are described in U.S. Pat. No. 2,899,335. An example of one such useful alkylated aromatic hydrocarbon liquid which is commercially available is Solvesso 100 made by Exxon Corp. Solvesso 100 has a boiling point in the range of about 157° C. to about 177° C. and is composed of 9 percent xylene, 16 percent of other monoalkyl benzenes, 34 percent dialkyl benzenes, 37 percent trialkyl benzenes, and 4 percent aliphatics. Typically, whether solid or liquid at normal room temperatures, i.e., about 22° C., the electrically insulating carrier material used in the present invention is a material having a resistivity greater than about $10^9$ ohm-cms, preferably greater than about $10^{12}$ ohm-cm. When the electrically photosensitive particles used in the present invention are incorporated in a carrier material, such as one of the above-described electrically insulating liquids, various other addenda may also be incorporated in the resultant imaging suspension. For example, various charge control agents may be incorporated in such a suspension to improve the uniformity of charge polarity of the electrically photosensitive particles dispersed in the liquid suspension. Such charge control agents are well known in the field of liquid electrographic developer compositions where they are employed for purposes substantially similar to that described herein. Thus, extensive discussion of these materials herein is deemed unnecessary. These materials are typically polymeric materials incorporated by admixture thereof into the liquid carrier vehicle of the suspension. In addition to, and possibly related to, the aforementioned enhancement of uniform charge polarity, it has been found that the charge control agents often provide more stable suspensions, i.e., suspensions which exhibit substantially less settling out of the dispersed photosensitive particles.

In addition to the foregoing charge control agent materials, various polymeric binder materials such as various natural, semi-synthetic or synthetic resins, may be dispersed or dissolved in the electrically insulating carrier to serve as a fixing material for the final photosensitive particle image formed on one of the spaced electrodes used in electrophoretic migration imaging systems. Here again, the use of such fixing addenda is conventional and well known in the closely related art of liquid electrographic developer compositions so that extended discussion thereof is unnecessary herein.

The process of the present invention will be described in more detail with reference to the accompanying drawing, FIG. 1, which illustrates a typical apparatus which employs the electrophoretic migration imaging process of the invention.

FIG. 1 shows a transparent electrode 1 supported by two rubber drive rollers 10 capable of imparting a translating motion to electrode 1 in the direction of the arrow. Electrode 1 may be composed of a layer of optically transparent material, such as glass or an electrically insulating, transparent polymeric support such as polyethylene terephthalate, covered with a thin, optically transparent, conductive layer such as tin oxide, indium oxide, nickel, and the like. Optionally, depending upon the particular type of electrophoretic migration imaging process desired, the surface of electrode 1 may bear a "dark charge exchange" material, such as a solid solution of an electrically insulating polymer and 2,4,7,trinitro-9-fluorenone as described by Groner in U.S. Pat. No. 3,976,485 issued Aug. 24, 1976.

Spaced opposite electrode 1 and in pressure contact therewith is a second electrode 5, an idler roller which serves as a counter electrode to electrode 1 for producing the electric field used in the electrophoretic migration imaging process. Typically, electrode 5 has on the surface thereof a thin, electrically insulating layer 6. Electrode 5 is connected to one side of the power source 15 by switch 7. The opposite side of the power source 15 is connected to electrode 1 so that as an exposure takes place, switch 7 is closed and an electric field is applied to the electrically photosensitive particulate material 4 dispersed in an electrically insulating carrier material such as described hereinabove.

The electrically photosensitive particulate material 4 may be positioned between electrodes 1 and 5 by applying material 4 to either or both of the surfaces of electrodes 1 and 5 prior to the imaging process or by injecting electrically photosensitive imaging material 4 between electrodes 1 and 5 during the electrophoretic migration imaging process.

As shown in the FIG. 1, exposure of electrically photosensitive particulate material 4 takes place by use of an exposure system consisting of light source 8, an original image 11 to be reproduced, such as a photographic transparency, a lens system 12, and any necessary or desirable radiation filters 13, such as color filters, whereby electrically photosensitive material 4 is irradiated with a pattern of activating radiation corresponding to original image 11. Although the electrophoretic migration imaging system represented in FIG. 1 shows electrode 1 to be transparent to activating radiation from light source 8, it is possible to irradiate electrically photosensitive particulate material 4 in the nip 21 between electrodes 1 and 5 without either of electrodes 1 or 5 being transparent. In such a system, although not shown in FIG. 1, the exposure source 8 and lens system 12 is arranged so that image material 4 is exposed in the nip or gap 21 between electrodes 1 and 5.

As shown in FIG. 1, electrode 5 is a roller electrode having a conductive core 14 connected to power source 15. The core is in turn covered with a layer of insulating material 6, for example, baryta paper. Insulating material 6 serves to prevent or at least substantially reduce the capability of electrically photosensitive particulate material 4 to undergo a radiation induced charge alteration upon interaction with electrode 5. Hence, the term "blocking electrode" may be used, as is conventional in the art of electrophoretic migration imaging, to refer to electrode 5.

Although electrode 5 is shown as a roller electrode and electrode 1 is shown as essentially a translatable, flat plate electrode in FIG. 1, either or both of these electrodes may assume a variety of different shapes such as a web electrode, rotating drum electrode, plate electrode, and the like as is well known in the field of electrophoretic migration imaging. In general, during a typical electrophoretic migration imaging process wherein electrically photosensitive material 4 is dispersed in an electrically insulating, liquid carrier, electrodes 1 and 5 are spaced such that they are in pressure contact or very close to one another during the electrophoretic migration imaging process, e.g., less than 50 microns apart. However, where electrically photosensitive particulate material 4 is dispersed simply in an air gap between electrodes 1 and 5 or in a carrier such as a layer of heat-softenable or other liquefiable material coated as a separate layer on electrode 1 and/or 5, these electrodes may be spaced more than 50 microns apart during the imaging process.

The strength of the electric field imposed between electrodes 1 and 5 during the electrophoretic migration imaging process of the present invention may vary considerably; however, it has generally been found that optimum image density and resolution are obtained by increasing the field strength to as high a level as possible without causing electrical breakdown of the carrier medium in the electrode gap. For example, when electrically insulating liquids such as isoparaffinic hydrocarbons are used as the carrier in the imaging apparatus of FIG. 1, the applied voltage across electrodes 1 and 5 typically is within the range of from about 100 volts to about 4 kilovolts or higher.

As explained hereinabove, image formation occurs in electrophoretic migration imaging processes as the result of the combined action of activating radiation and electric field on the electrically photosensitive particulate material 4 disposed between electrodes 1 and 5 in the attached drawing. Typically, for best results, field application and exposure to activating radiation occur concurrently. However, as would be expected, by appropriate selection of various process parameters such as field strength, activating radiation intensity, incorporation of suitable light sensitive addenda in or together with the electrically photosensitive material of formula I used in the present invention, e.g., by incorporation of a persistent photoconductive material, and the like, it is possible to alter the timing of the exposure and field application events so that one may use sequential exposure and field application events rather than concurrent field application and exposure events.

When disposed between imaging electrodes 1 and 5 of FIG. 1, electrically photosensitive particulate material 4 exhibits an electrostatic charge polarity, either as a result of triboelectric interaction of the particles or as a result of the particles interacting with the carrier material in which they are dispersed, for example, an electrically insulating liquid, such as occurs in conventional liquid electrographic developing compositions composed of toner particles which acquire a charge upon being dispersed in an electrically insulating carrier liquid.

Image discrimination occurs in the electrophoretic migration imaging process of the present invention as a result of the combined application of electric field and activating radiation on the electrically photosensitive particulate material dispersed between electrodes 1 and 5 of the apparatus shown in FIG. 1. That is, in a typical imaging operation, upon application of an electric field between electrodes 1 and 5, the particles 4 of charge-bearing, electrically photosensitive material are attracted in the dark to either electrodes 1 or 5, depending upon which of these electrodes has a polarity opposite to that of the original charge polarity acquired by the electrically photosensitive particles. And, upon exposing particles 4 to activating electromagnetic radiation, it is theorized that there occurs neutralization or reversal of the charge polarity associated with either the exposed or unexposed particles. In typical electrophoretic migration imaging systems wherein electrode 1 bears a conductive surface, the exposed, electrically photosensitive particles 4, upon coming into electrical contact with such conductive surface, undergo an alteration (usually a reversal) of their original charge polarity as a result of the combined application of electric field and activating radiation. Alternatively, in the case wherein the surface of electrode 1 bears a dark charge exchange material as described by Groner in aforementioned U.S. Pat. No. 3,976,485, one obtains reversal of the charge polarity of the unexposed particles, while maintaining the original charge polarity of the exposed electrically photosensitive particles, as these particles come into electrical contact with the dark charge exchange surface of electrode 1. In any case, upon the application of electric field and activating radiation to electrically photosensitive particulate material 4 disposed between electrodes 1 and 5 of the apparatus shown in FIG. 1, one can effectively obtain image discrimination so that an image pattern is formed by the electrically photosensitive particles which corresponds to the original pattern of activating radiation. Typically, using the apparatus shown in FIG. 1, one obtains a visible image on the surface of electrode 1 and a complementary image pattern on the surface of electrode 5.

Subsequent to the application of the electric field and exposure to activating radiation, the images which are formed on the surface of electrodes 1 and/or 5 of the apparatus shown in FIG. 1 may be temporarily or permanently fixed to these electrodes or may be transferred to a final image receiving element. Fixing of the final particle image can be effected by various techniques, for example, by applying a resinous coating over the surface of the image bearing substrate. For example, if electrically photosensitive particles 4 are dispersed in a liquid carrier between electrodes 1 and 5, one may fix the image or images formed on the surface of electrodes 1 and/or 5 by incorporating a polymeric binder material in the carrier liquid. Many such binders (which are well known for use in liquid electrophotographic liquid developers) are known to acquire a charge polarity upon being admixed in a carrier liquid and therefore will, themselves, electrophoretically migrate to the surface of one or the other of the electrodes. Alternatively, a coating of a resinous binder (which has been admixed in the carrier liquid), may be formed on the surfaces of electrodes 1 and/or 5 upon evaporation of the liquid carrier.

As indicated, trans-epindolidione has an especially useful yellow hue. Hence, trans-epindolidione is particularly suited for use in polychrome imaging processes which employ a mixture of two or more differently colored electrically photosensitive particles, e.g., a mixture of cyan particles which are principally sensitive to red light, magenta particles which are principally sensitive to green light, and yellow particles consisting at least partially of trans-epindolidione which is principally sensitive to blue light. When such a mixture of multicolored electrically photosensitive particles is formed, for example, in an electrically insulating carrier liquid, this liquid mixture of particulate material exhibits a black coloration. Preferably, the specific cyan, magenta, and yellow particles selected for use in such a polychrome imaging process are chosen so that their spectral response curves do not appreciably overlap whereby color separation and subtractive multicolor image reproduction can be achieved.

The following examples illustrate the invention. The stated parts and percentages are by weight unless otherwise stated.

EXAMPLES

Image Evaluation Apparatus

An image evaluation apparatus was used in each of the succeeding examples to carry out the electrophoretic migration imaging process described herein. This apparatus was a device of the type illustrated in FIG. 1. In this apparatus, a translating transparent polyethylene terephthalate support coated with a 0.1 mil thick conductive cermet (Cr.SiO) layer served as electrode 1 and was in pressure contact with a 10 centimeter diameter aluminum roller 14 covered with Kodak type III coated paper 6 which served as electrode 5. Electrode 1 was supported by two 2.8 cm. diameter rubber drive rollers 10 positioned beneath electrode 1 such that a 2.5 cm. opening, symmetric with the axis of the aluminum roller 14, existed to allow exposure of electrically photosensitive particles 4 to activating radiation. The original transparency 11 to be reproduced consisted of adjacent strips of clear (WO)*, red (W29)*, green (W61)* and blue (W47B)* filters. The original was taped to the back side of Electrode 1. The exposing activating radiation was supplied from a light source 8 consisting of a Kodak Ektagraphic® AV434 projector with 1 kilowatt Xenon® arc lamp. The light source was modified with a Kodak No. 5 flexible M-carbon 11 step 0.3 neutral density step tablet. The voltage between the electrodes (1 and 5) was about 2 kv. Electrode 1 was negative polarity in the case where electrically photosensitive particulate material 4 carried a positive electrostatic charge, and Electrode 1 was positive in the case where electrically photosensitive electrostatically charged particles were negatively charged. The translational speed of Electrode 1 was variable about 25 cm. per second. Residence time in exposure zone for each dispersion tested was about 10 milliseconds. The log of light intensity in the action zone was as follows:

| Filters | $\log_{10}I$ erg/cm²/sec |
|---|---|
| WO* Clear | 5.34 |
| W29* Red | 4.18 |
| W61* Green | 4.17 |
| W47B* Blue | 4.15 |

*Refers to Wratten Filter Numbers.

In the following examples, image formation occurs on the surfaces of Electrode 1 and electrode 5 after simultaneous application of light exposure and electric field to electrically photosensitive particulate material 4. In this image evaluation apparatus, the material to be evaluated for use as electrically photosensitive particulate material 4 was admixed with a liquid carrier as described below to form a liquid imaging dispersion which was placed in nip 21 between the electrodes 1 and 5. If the material being evaluated for use as material 4 possessed a useful level of electrical photosensitivity, one obtains a negative-appearing image reproduction of original 11 on electrode 5 and a complementary image on electrode 1.

IMAGING DISPERSION PREPARATION

Imaging dispersions were prepared to evaluate trans-epindolidione as well as other structurally similar materials. A stock solution of the dispersion components shown below was prepared. The stock solution was prepared simply by combining the listed components.

| Dispersion Components | |
|---|---|
| Isopar G | 2.2 g |
| Solvesso | 1.3 g. |
| Piccotex 100* | 1.4 g |
| PVT** | 0.1 g |

*Styrene-vinyl toluene copolymer
**Poly(vinyltoluene-co-laurylmethacrylate-co-lithium methacrylate-co-methacrylic acid) 56/40/3.6/0.4

A 5 g. aliquot of the stock solution was combined in a closed container with 0.045 g. of trans-epindolidione and 12 g. of Hamber 440 stainless steel balls. The preparation was then milled 3 hours on a paint shaker.

EXAMPLES 1-3

Three separate portions of trans-epindolidione pigment were extracted three different ways as follows:

Extractions

A — Trans-epindolidione was extracted with hot dimethylsulfoxide/then extracted with hot xylene.

B — Trans-epindolidione was extracted with dimethylsulfoxide at room temperature for 12 hours/then extracted with ether at room temperature.

C — Trans-epindolidione was extracted with boiling ethanol for 2 hours.

The pigments of each extraction was orange-yellow. Three different dispersions were formed according to the above procedures and the sensitometric characteristics of each were determined using a densitometer containing Kodak No. 5 flexible M-Carbon, 11 step wedge (0.3 ND.) Each extraction exhibited good sensitometry, and each exhibited electrophotosensitivity by forming complementary images on each electrode. The yellow color density was good considering both $D_{max}$ and $D_{min}$.

In all pigment samples resulting from Extractions A, B and C the sample color was orange-yellow and the charge on the dispersed particles was positive.

EXAMPLE 4

Two grams of crude trans-epindolidione was combined with 50 ml of dimethylformamide (DMF).

The mixture was stirred at reflux for 2 hours, then cooled and filtered. The fine yellow material was slurried with water and filtered. The pigment was then stirred for 30 minutes in 150 ml boiling water, filtered, and dried in vacuo at 75°.

An imaging dispersion was formed and the sensitometric characteristics thereof was determined as described above. The sensitivity of the dispersion was 0.5 ergs/cm². An image having excellent $D_{min}$ and $D_{max}$ was obtained.

EXAMPLE 5

In the course of our search for an acceptable yellow electrically photosensitive material, many materials were tested before discovering the usefulness of trans-epindolidione in electrophoretic migration imaging processes. Many of the unsuitable materials tested were structurally related to trans-epindolidione and/or possessed a yellow color. A number of such unsuitable materials are presented in Table I to emphasize the unexpected as well as the unpredictable nature of the present invention. Imaging dispersions of each of the listed materials were prepared and tested according to the procedures already described relative to Example 1. The data of the table shows the color and/or quality of the images formed with each material tested. Materials 1-9 and 13-15 are yellow materials which form poor or no images in electrophoretic imaging processes. Materials 11 and 12 exemplify the type of materials disclosed in aformentioned U.S. Pat. No. 3,474,020. This data shows that while these materials form fair to good images, such images are not yellow. It is also worth noting that materials 11 and 12 would be unsuitable for use in subtractive multicolor imaging systems because of their color. The image quality resulting from the use of each of Table I materials is determined upon the basis of a visual observation of the image which took into account $D_{min}$, $D_{max}$, and image color.

TABLE I

| Number | Material | Image Quality |
|---|---|---|
| 1 | 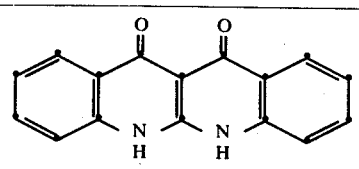 | No Image |

TABLE I-continued
| Number | Material | Image Quality |
|---|---|---|
| 2 | 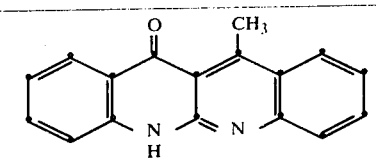 | No Image |
| 3 | 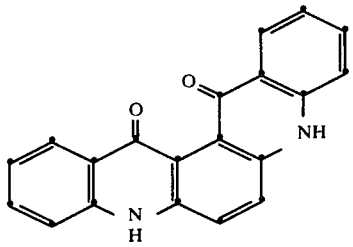 | Poor |
| 4 | 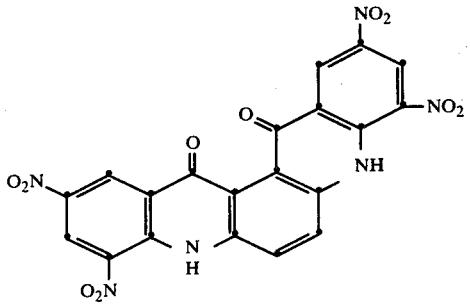 | No Image |
| 5 | 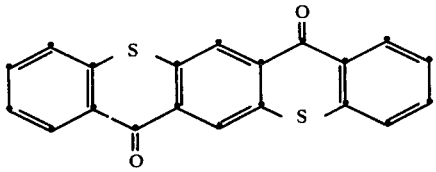 | Poor |
| 6 | 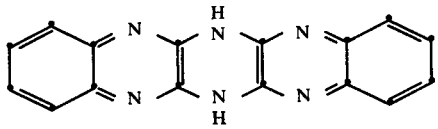 | Fair (Pale Yellow) |
| 7 | 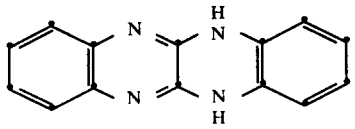 | No Image |
| 8 | 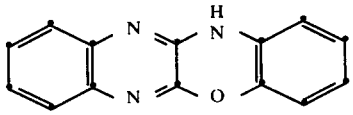 | No Image |
| 9 | 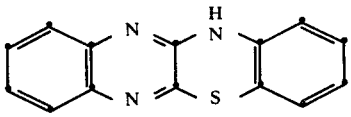 | Poor (Pale Yellow) |
| 10 | 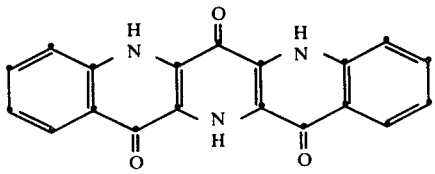 | Poor (Pale Brown-Red) |

TABLE I-continued

| Number | Material | Image Quality |
|---|---|---|
| 11 | 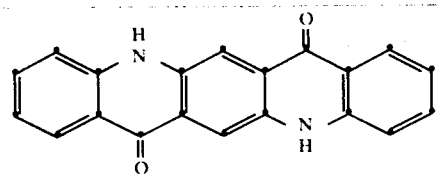 | Fair (Red-Violet Image) |
| 12 | 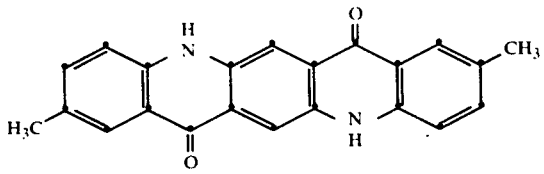 | Good (Blue-Violet Image) |
| 13 | 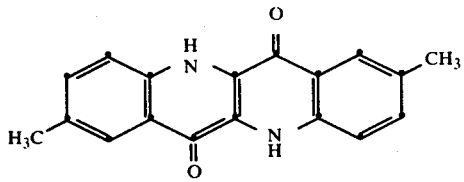 | Poor (Yellow Image) |
| 14 | 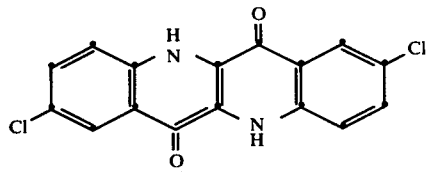 | Poor |
| 15 | 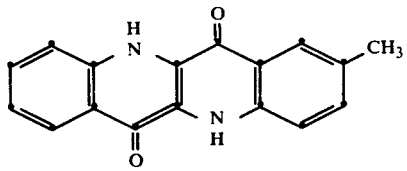 | Poor |

The invention has been described in detail with particular reference to certain preferred embodiments thereof, but it will be understood that variations and modifications can be effected within the spirit and scope of the invention.

We claim:

1. A migration imaging process which comprises subjecting electrically photosensitive colorant particles positioned between at least two electrodes to an applied electric field and exposing said material to an image pattern of radiation to which the material is photosensitive, thereby obtaining image formation on at least one of said electrodes, characterized in that at least a portion of said particles is trans-epindolidione.

2. A photoelectrophoretic migration imaging process which comprises subjecting an electrically insulating carrier material positioned between at least two electrodes to an applied electric field and exposing said carrier material to an image pattern of radiation, said carrier material containing electrically photosensitive particles which comprise at least one colorant component photosensitive to said radiation, thereby obtaining image formation on at least one of said electrodes, characterized in that at least a portion of said particles is trans-epindolidione.

3. A process according to claim 2 wherein said carrier material is a liquid.

4. A photoelectrophoretic migration imaging process which comprises subjecting an electrically insulating carrier material positioned between at least two electrodes to an applied electric field and exposing said carrier material to an image pattern of radiation, said carrier material containing electrically photosensitive particles which comprise at least three different color components photosensitive to said radiation thereby obtaining polychrome image formation on at least one of said electrodes characterized in that at least a portion of said electrically photosensitive particles is trans-epindolidione.

5. A migration imaging process according to claim 4, wherein said carrier is a liquid.

6. A migration imaging dispersion comprising a carrier and electrically photosensitive colorant particles characterized in that at least a portion of said particles is trans-epindolidione.

7. A dispersion according to claim 2 wherein said carrier material is a liquid.

8. A photoelectrophoretic migration imaging dispersion for polychrome imaging comprising a carrier material and electrically photosensitive particles which comprise at least three different color components characterized in that at least a portion of said electrically photosensitive particles is trans-epindolidione.

9. A dispersion according to claim 8 wherein said carrier is a liquid.

* * * * *